US011774899B2

(12) United States Patent
Akama

(10) Patent No.: US 11,774,899 B2
(45) Date of Patent: Oct. 3, 2023

(54) IMAGE FORMING APPARATUS INCLUDING HANDLE MEMBER FOR TRANSPORTATION

(71) Applicant: Shiro Akama, Tokyo (JP)

(72) Inventor: Shiro Akama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/930,453

(22) Filed: Sep. 8, 2022

(65) Prior Publication Data

US 2023/0109034 A1 Apr. 6, 2023

(30) Foreign Application Priority Data

Oct. 4, 2021 (JP) ..... 2021-163632

(51) Int. Cl.
*G03G 21/16* (2006.01)

(52) U.S. Cl.
CPC ..... *G03G 21/1619* (2013.01)

(58) Field of Classification Search
CPC ..... G03G 21/1619
See application file for complete search history.

(56) References Cited

U.S. PATENT DOCUMENTS

2009/0123175 A1* 5/2009 Takemoto ..... G03G 21/1619 399/107
2009/0148179 A1* 6/2009 Tamura ..... G03G 21/1619 399/107
2013/0064567 A1 3/2013 Akama et al.
2013/0287432 A1* 10/2013 Ikeda ..... G03G 21/1619 399/107
2014/0248066 A1 9/2014 Akiyama et al.
2016/0109038 A1* 4/2016 Matsumoto ..... G03G 21/1619 399/107
2016/0161903 A1 6/2016 Akama et al.
2016/0187825 A1 6/2016 Ueda et al.
2019/0286047 A1 9/2019 Ishimitsu et al.
2021/0103247 A1 4/2021 Akama et al.
2021/0356902 A1* 11/2021 Tashiro ..... G03G 21/1619

FOREIGN PATENT DOCUMENTS

JP 2005-326709 11/2005
JP 2012-194220 10/2012
JP 2016-014809 1/2016

* cited by examiner

*Primary Examiner* — Sandra Brase
(74) *Attorney, Agent, or Firm* — IPUSA, PLLC

(57) ABSTRACT

An image forming apparatus including an apparatus housing that encases an image forming device. The apparatus housing includes a housing side face, a handle member, and a frame. The housing side face is held when the apparatus housing is lifted. The handle member is provided on the housing side face. The handle member includes a portion recessed inward from the housing side face of the apparatus housing and a guide groove having a slot shape extending in a vertical direction of the apparatus housing. The frame includes a guide having a length substantially equal to a width of the guide groove. The handle member is movable in the vertical direction of the apparatus housing by the guide groove and the guide. The frame restricts movement of the handle member when the handle member moves upward and contact the frame.

4 Claims, 7 Drawing Sheets

IMAGE FORMING APPARATUS INCLUDING HANDLE MEMBER FOR TRANSPORTATION

CROSS-REFERENCE TO RELATED APPLICATION

This patent application is based on and claims priority pursuant to 35 U.S.C. § 119(a) to Japanese Patent Application No. 2021-163632, filed on Oct. 4, 2021, in the Japan Patent Office, the entire disclosure of which is hereby incorporated by reference herein.

BACKGROUND

Technical Field

Embodiments of the present disclosure relate to an image forming apparatus including a handle member for the transportation of the image forming apparatus.

Background Art

Image forming apparatuses are known to form an image a recording medium. Some image forming apparatuses are known to include a medium container that includes a medium supplier, an image forming device, and a medium ejection tray that includes a medium ejector in one housing. Such image forming apparatuses may have a structure for supporting the transportation of the image forming apparatus, so that a carrier can easily lift the housing. Specifically, such image forming apparatuses may include a carrier handle made of a resin material near the joint at which the side face of the housing and the bottom face of the housing are coupled to each other.

In addition, to prevent deformation or damage of the carrier handle due to the load during transportation, such image forming apparatuses are known to employ a component having high rigidity such as metal to restrict the deformation or movement of the handle including the carrier handle in the upward direction. For example, an image forming apparatus is known to include a handle having a portion inwardly recessed from the housing support side face of the housing and a reinforcement member covering respective functional components disposed inside the housing. The reinforcement member that is disposed between the housing support side face and the functional components with distance from each other. The handle is disposed facing the functional components.

SUMMARY

Embodiments of the present disclosure described herein provide a novel image forming apparatus including an apparatus housing that encases an image forming device.

The apparatus housing includes a housing side face, a handle member, and a frame. The housing side face is held when the apparatus housing is lifted. The handle member is provided on the housing side face. The handle member includes a portion recessed inward from the housing side face of the apparatus housing and a guide groove having a slot shape extending in a vertical direction of the apparatus housing. The frame includes a guide having a length substantially equal to a width of the guide groove. The handle member is movable in the vertical direction of the apparatus housing by the guide groove and the guide. The frame restricts movement of the handle member when the handle member moves upward and contact the frame.

BRIEF DESCRIPTION OF THE SEVERAL VIEWS OF THE DRAWINGS

Exemplary embodiments of this disclosure will be described in detail based on the following figures, wherein.

Figure 1:
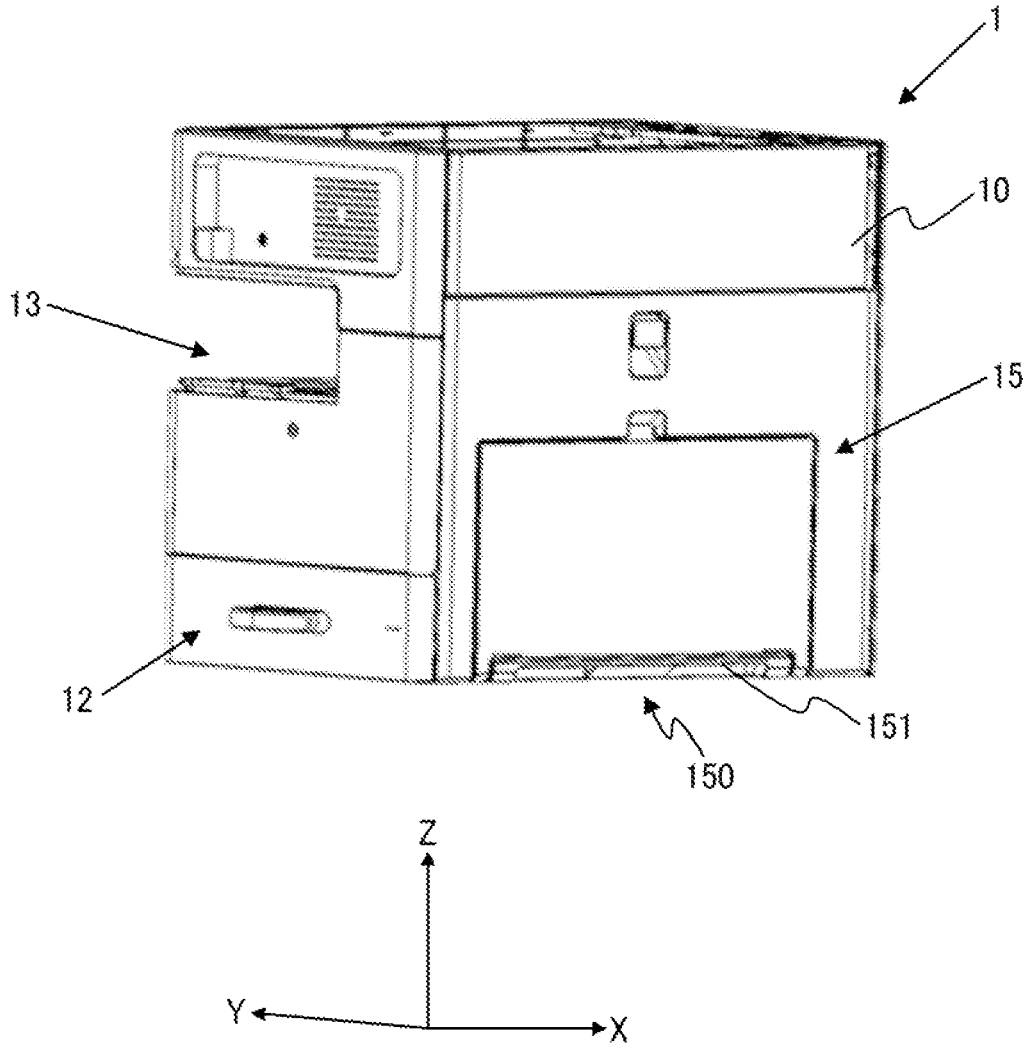
FIG. 1 is a perspective external view of an image forming apparatus in its entirety, according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiments of the present disclosure are described below with reference to the attached drawings.

Overall Structure

FIG. 1 is a perspective external view of a printer 1 serving as an image forming apparatus in its entirety, according to an embodiment of the present disclosure.

The printer 1 has a configuration like the configuration of a typical image forming apparatus. Specifically, the printer 1 includes an image forming device included in a housing 10, a medium feeding tray 12, and a medium ejection tray 13. The medium feeding tray 12 serves as a medium container to contain a sheet-shaped medium or media to be fed to the image forming device. The medium ejection tray 13 stacks the media after each medium having an image formed in the image forming device is ejected from the image forming device. Since these configurations and operations of the above-described components are not directly related to the features of the present disclosure, the detailed descriptions and illustrations of the components are omitted and the descriptions of the portions including the features of the present disclosure are given below.

As illustrated in FIG. 1, the printer 1 has an external appearance in a rectangular parallelepiped shape and has a plurality of side faces. The plurality of side faces includes one side face having a carrier handle used for transportation of the printer 1. The side face is a support side face 15 that serves as a housing side face for supporting the printer 1 during the transportation.

The support side face 15 corresponds to a part of the side face or the rear face with respect to the front face of the printer 1. A handle portion 150 serving as a carrier handle is formed at the joint of the support side face 15 and the bottom face of the printer 1. The handle portion 150 corresponds to a cutout portion of a handle member 151 that includes a structure supported by the support side face 15 of the printer 1

Configuration of Handle Portion 150

Figure 2A:
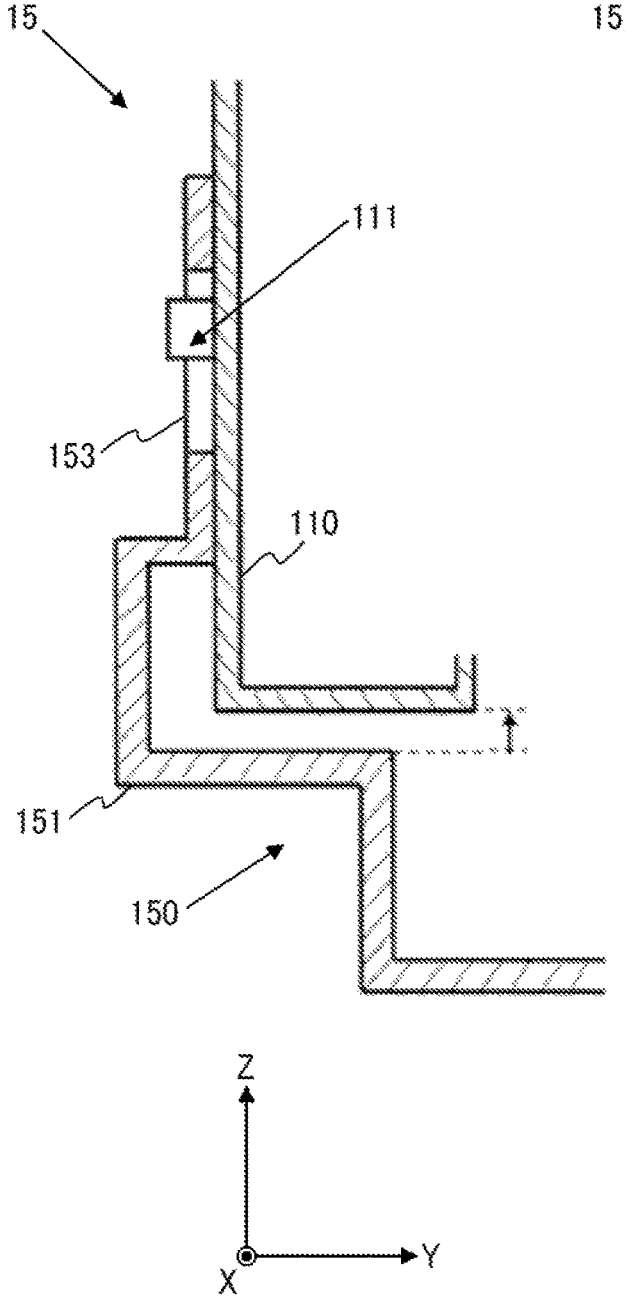
FIGS. 2A and 2B are partially enlarged cross-sectional views of a handle portion of the image forming apparatus according to the present embodiment.
Figure 2B:
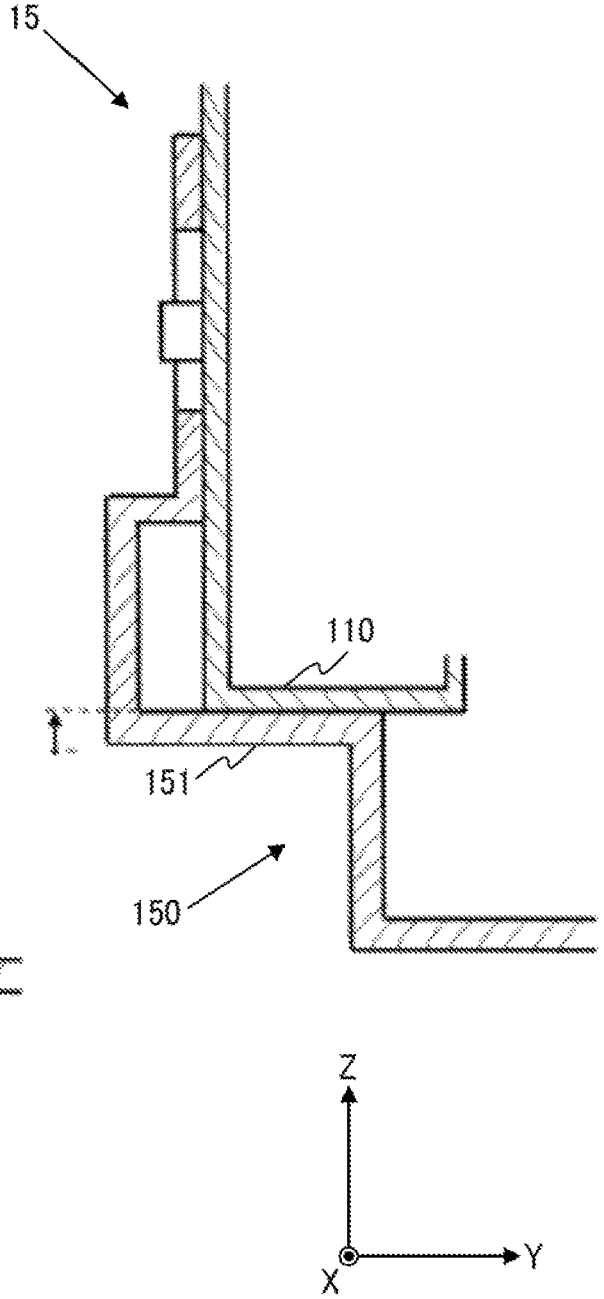

FIGS. 2A and 2B are partially enlarged cross-sectional views of the handle portion 150 as a part of the support side face 15.

As illustrated in FIGS. 2Aand 2B, a frame 110 is disposed on the inner side of the support side face 15 and serves as a frame to support the functional components provided for the printer 1. The handle member 151 is supported by the frame 110, so as to form the handle portion 150.

The frame 110 is disposed inside the printer 1 and is made of a material having high rigidity such as metal. The frame 110 holds the functional components that execute the operation control of the printer 1 at respective given positions.

The handle member 151 is made of resin to enhance the safety when transporting the printer 1 and the gripping performance of the housing 10. The handle member 151 is also a part of a protection cover that protects the exterior of the frame 110. Further, the handle member 151 is provided for the handle portion 150 that is a cutout portion where the carrier puts the hand on when transporting the printer 1. To prevent the handle member 151 from being deformed or damaged when the load due to the weight of the printer 1 is applied to the handle member 151 during the transportation of the printer 1, the frame 110 is provided with a restricting portion that restricts the deformation or movement of the handle member 151 in the upward direction.

A hole-shaped guide groove 153 having a longitudinal dimension in the vertical direction (Z direction) is formed in the handle member 151. In other words, the shape of the guide groove 153 in a plan view is a long hole or a slotted hole.

A guide 111 having a shape to be hooked to the guide groove 153 is fixed to the frame 110.

Figure 3:
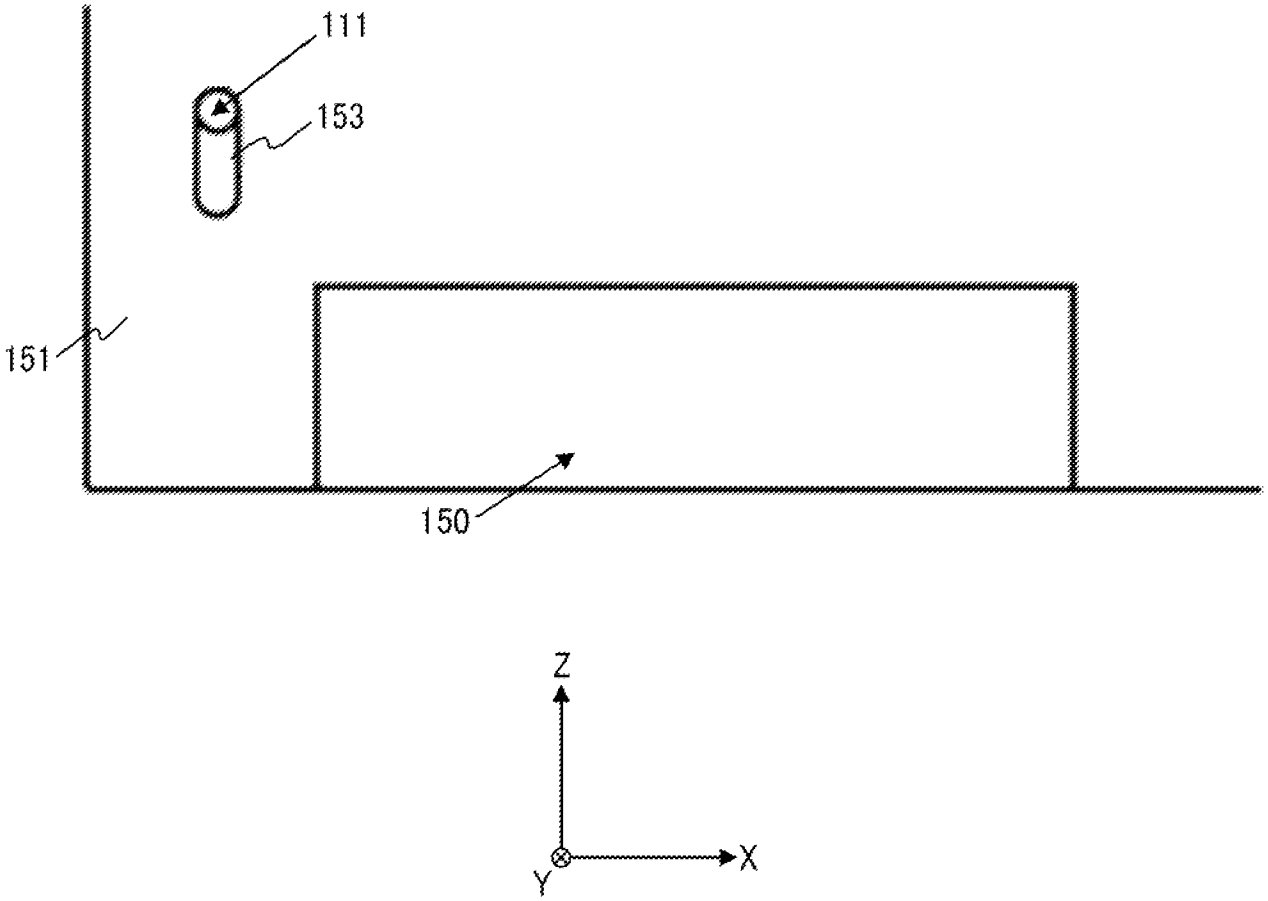
FIG. 3 is a diagram illustrating a support side face of the image forming apparatus, viewed in a Y direction, according to an embodiment of the present embodiment.

FIG. 3 is a diagram illustrating a support side face 15 of the printer 1, viewed in a Y direction, according to an embodiment of the present embodiment.

A detailed description is given of the function and operations of the handle portion 150, with reference to FIGS. 2A, 2B, and 3. The guide 111 is projected from the wall of the frame 110 to be hooked to the guide groove 153 formed in the handle member 151.

As illustrated in FIG. 3, the handle portion 150 is formed with a given length at the center in the depth direction (X direction) of the handle member 151 and has a recessed portion in the inner direction (Y direction) of the housing of the printer 1. This recessed portion serves as at least a part of the handle portion 150.

The guide groove 153 is formed above (Z direction) a position deviated from the position of the handle portion 150 in the X direction, and has the width dimension substantially equal to the diameter dimension of the guide 111.

A description is given of the handle portion 150 when the printer 1 is lifted and transported by holding the handle portion 150, with reference to FIGS. 2A and 2B.

Specifically, FIG. 2A illustrates the handle portion 150 when the printer 1 is not lifted.

FIG. 2B illustrates the handle portion 150 when the printer 1 is lifted.

As illustrated in FIG. 2B, when the handle member 151 is lifted to move the printer 1 installed at the given position, the handle member 151 slides upward to the frame 110. Then, the cutout portion (recessed portion) of the handle member 151 contacts the lower face of the frame 110. This contact of the handle member 151 to the frame 110 restricts the movement of the handle member 151 in the upward direction due to the load during the transportation of the printer 1. In other words, when the printer 1 is transported, the handle member 151 contacts the frame 110. Due to such a configuration, the handle portion 150 is prevented from being deformed or damaged.

Figure 4:
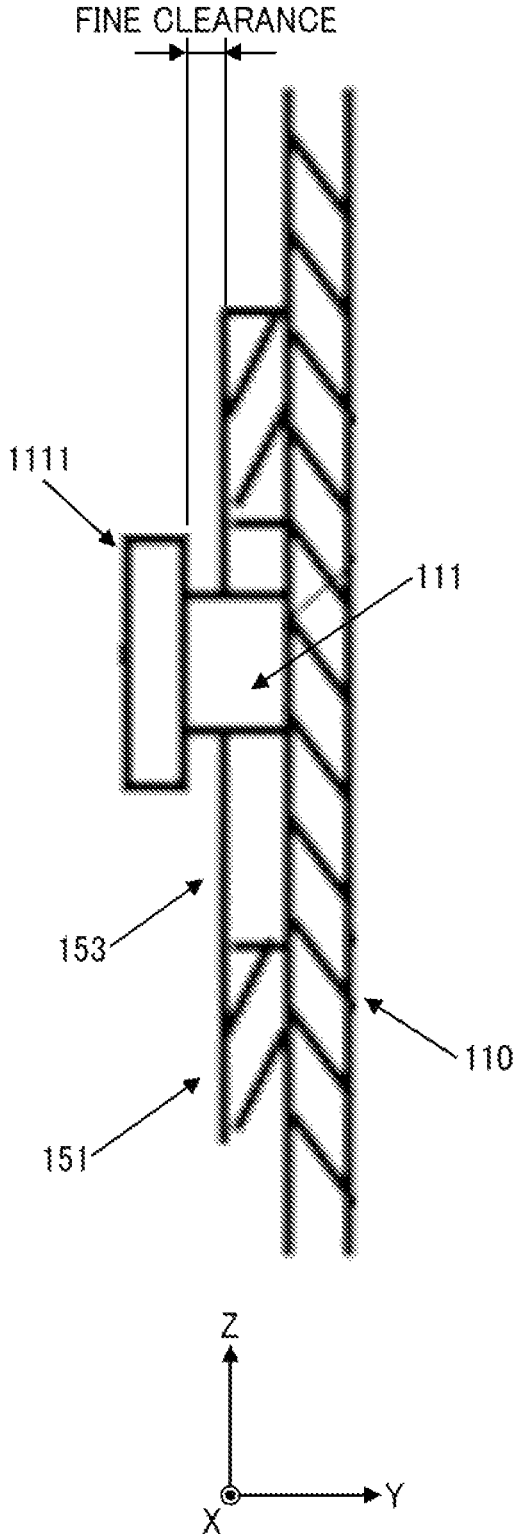
FIG. 4 is an enlarged cross-sectional view of a holding portion of a handle member of the image forming apparatus with respect to a frame, according to the present embodiment.

FIG. 4 is an enlarged cross-sectional view of the portion on which the handle member 151 is slidably held by the frame 110.

As illustrated in FIG. 4, a restraint 1111 is disposed at the tip end of the guide 111. The restraint 1111 is disposed at the position where a fine clearance is formed between the restraint 1111 and the outer face (outer surface) of the handle member 151.

The restraint 1111 is a circular member provided at the tip end of the guide 111 and has the diameter larger than the width of the guide groove 153. Due to this configuration, the movement of the guide 111 in the Y direction is restricted by the restraint 1111. As a result, when the handle member 151 moves in the Z direction (upward direction) with respect to the frame 110, it is possible to prevent the handle member 151 from falling off from the frame 110.

Figure 5:
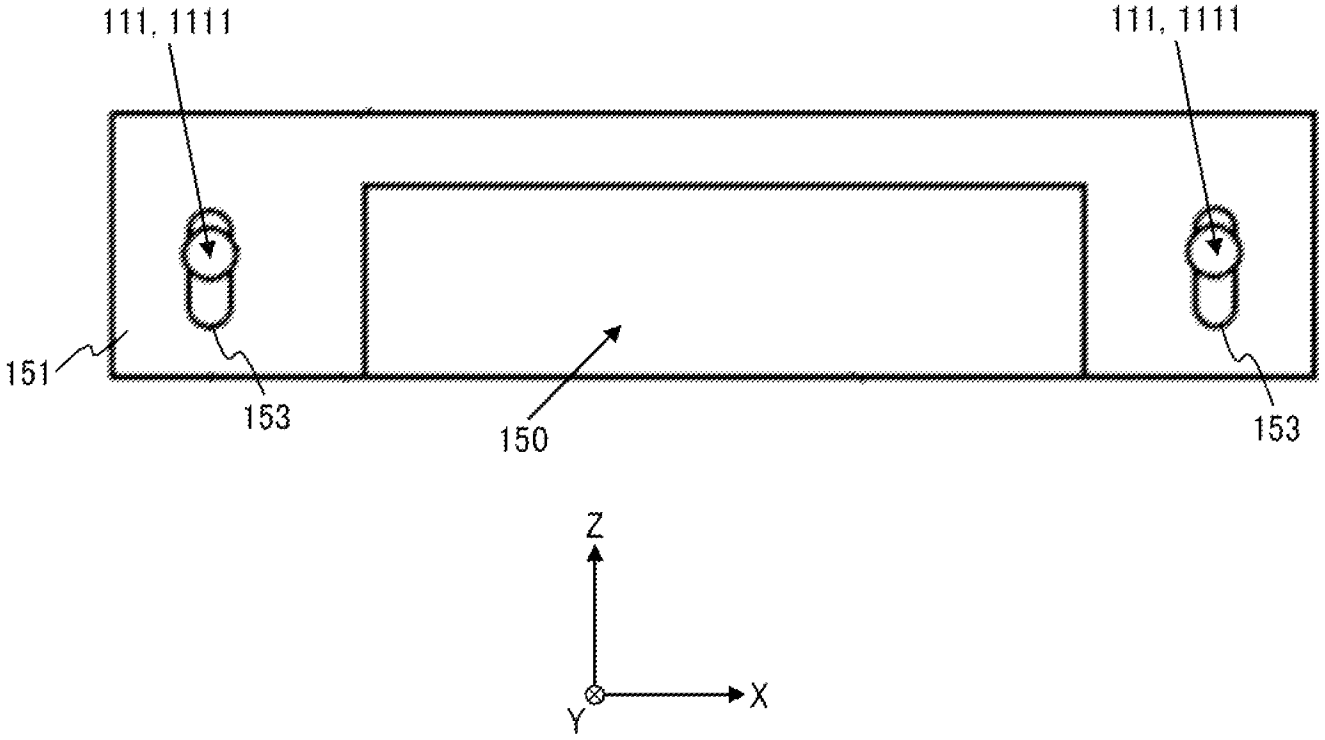
FIG. 5 is a diagram illustrating the support side face of the image forming apparatus, viewed in the Y direction, according to another embodiment of the present disclosure.

FIG. 5 is a diagram illustrating the support side face of the printer 1, viewed in the Y direction, according to another embodiment of the present disclosure.

As illustrated in FIG. 5, the guide groove 153 and the guide 111 including the restraint 1111 may be provided near both ends of the handle member 151 across the handle portion 150. As illustrated in FIG. 5, sets of the guide groove 153 and the guide 111 including the restraint 1111 are provided at multiple positions in the handle member 151. By so doing, the handle member 151 can be moved in the vertical direction without falling off from the frame 110.

Like the configuration of the handle member 151 illustrated in FIG. 5, two sets of the guide groove 153 and the guide 111 including the restraint 1111 are provided in the handle member 151. By so doing, it is more likely to prevent the handle member 151 from falling off. However, the present disclosure is not limited to the above-described configuration. Three or more sets of the guide groove 153 and the guide 111 including the restraint 1111 may be provided at respective positions in the handle member 151. If the set of the guide groove 153 and the guide 111 including the restraint 1111 is provided at a position at which the handle member 151 is prevented from falling off, the position of the set of the guide groove 153 and the guide 111 including the restraint 1111 is not limited to the positions illustrated in FIGS. 4 and 5 and can be selected appropriately.

Figure 6:
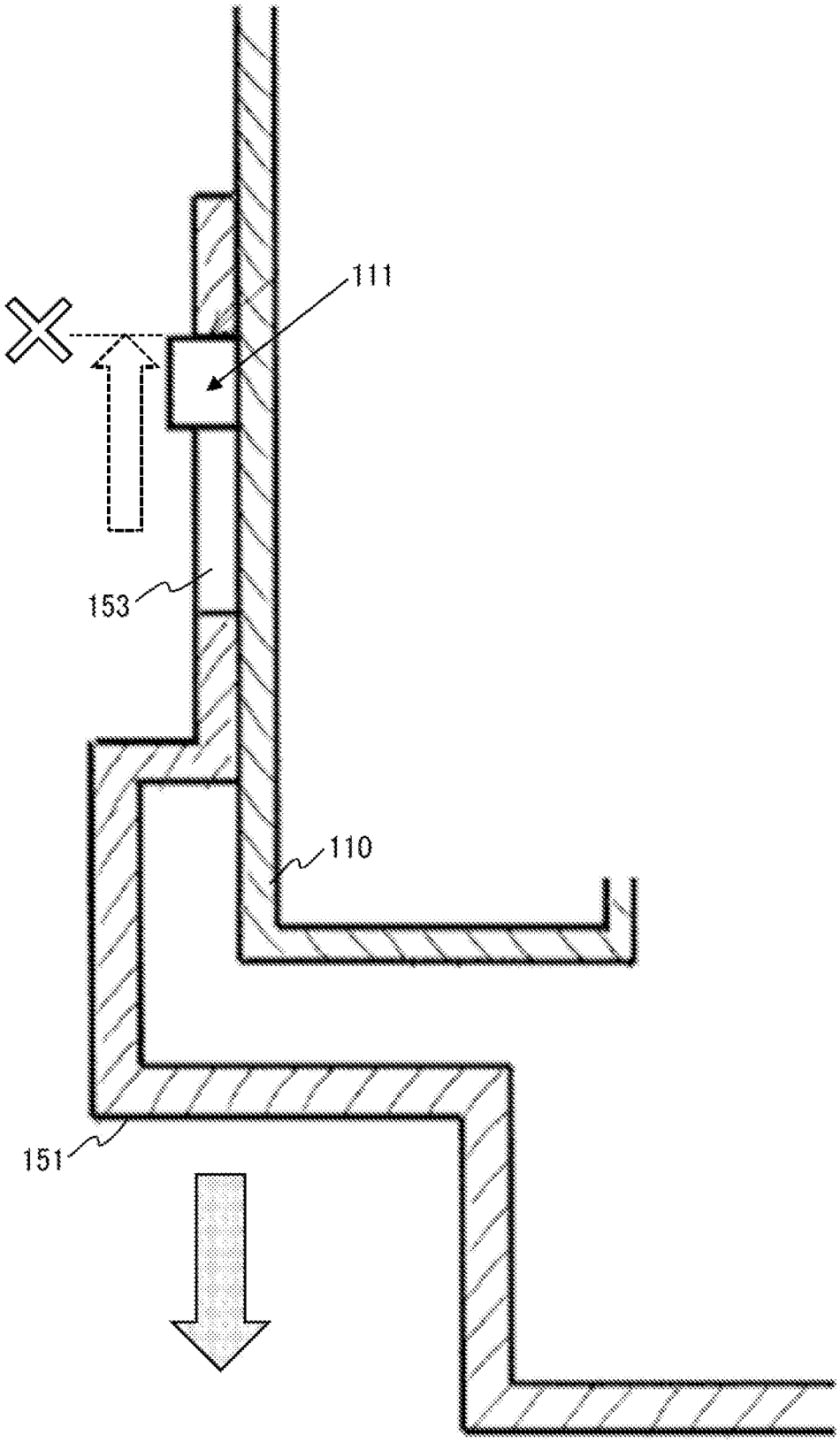
FIG. 6 is a partially enlarged cross-sectional view of the handle member for explaining how the handle member according to the present embodiment moves.

FIG. 6 is a partially enlarged cross-sectional view of the handle member 151 for explaining how the handle member 151 according to the present embodiment moves.

As illustrated in FIG. 6, when the handle member 151 moves downward due to the own weight, the upper end of the guide groove 153 provided in the handle member 151 contacts the guide 111 provided in the frame 110. By so doing, the movement of the handle member 151 is restricted. This restriction of the handle member 151 is maintained except during the transportation of the printer 1.

Figure 7:
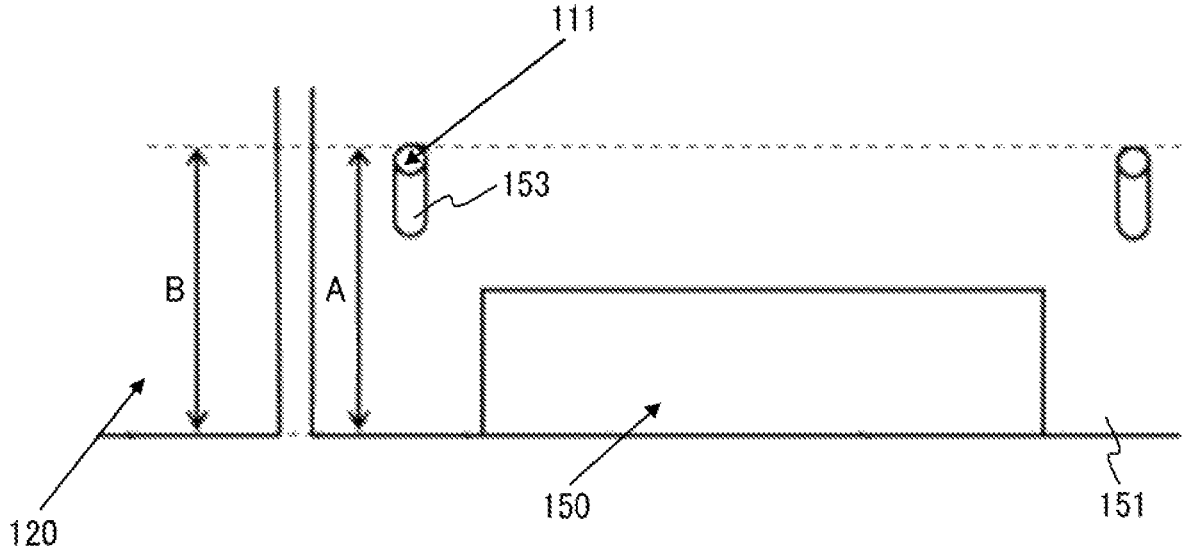
FIG. 7 is a diagram illustrating a relation of the position of the support side face including the handle portion according to the present embodiment and the position of an adjacent cover including a face adjacent to the support side face.

FIG. 7 is a diagram illustrating the relation of the position of the support side face 15 including the handle member 151 having the handle portion 150 and the position of an adjacent cover 120 including a face adjacent to the support side face 15.

As illustrated in FIG. 7, the distance between the upper end of the guide groove 153 of the handle member 151 and the lower end of the handle member 151 is defined as a "distance A". The distance between the lower end of the adjacent cover 120 and the position corresponding to the upper end of the guide groove 153 of the handle member 151 is defined as a "distance B". The handle member 151 is configured such that the distance A is substantially equal to the distance B on the support side face 15.

Due to such a configuration, the lower face of the handle member 151 serving as a part of the support side face 15 is maintained to be at substantially the same position as the position of the lower face of the adjacent cover 120 that is adjacent to the lower face of the handle member 151, except for the time of transportation of the printer 1. As a result, the lower end of the handle member 151 and the lower end of the adjacent cover 120 are aligned, and the quality of the external view of the printer 1 is maintained.

Effects

As described above, the printer 1 according to the present embodiment has a configuration in which the handle member 151 as a part of the support side face 15 can move in the vertical direction with respect to the frame 110 that protects and holds the inner structural components (functional components) of the printer 1. When the handle portion 150 included in the handle member 151 is lifted for transportation of the printer 1, for example, the handle member 151 moves upward to contact the lower face of the frame 110. As a result, deformation or damage that can occur to the handle member 151 when the printer 1 is transported can be prevented.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

What is claimed is:

1. An image forming apparatus comprising:

an apparatus housing encasing an image forming device, the apparatus housing including:

a housing side face held when the apparatus housing is lifted;

a handle member provided on the housing side face, the handle member including a portion recessed inward from the housing side face of the apparatus housing and a guide groove having a slot shape extending in a vertical direction of the apparatus housing; and a frame including a guide having a length substantially equal to a width of the guide groove, the handle member being movable in the vertical direction of the apparatus housing by the guide groove and the guide, the frame being configured to restrict movement of the handle member when the handle member moves upward and contact the frame.

2. The image forming apparatus according to claim 1, wherein the guide includes a restraint at an end, with a clearance between the restraint and the handle member.

3. The image forming apparatus according to claim 1, wherein the guide groove of the handle member has an upper end that contacts the guide when the handle member moves downward from the frame.

4. The image forming apparatus according to claim 1, wherein the apparatus housing includes an adjacent cover disposed adjacent to the handle member, and wherein a distance between an upper end of the guide groove of the handle member and a lower end of the handle member is substantially equal to a distance between a lower end of the adjacent cover and a position corresponding to the upper end of the guide groove of the handle member.

* * * * *